US008171979B2

(12) United States Patent
Arai et al.

(10) Patent No.: US 8,171,979 B2
(45) **Date of Patent: *May 8, 2012**

(54) METHOD FOR PRODUCING CARBON NANOCOMPOSITE METAL MATERIAL AND METHOD FOR PRODUCING METAL ARTICLE MOLDED THEREFROM

(75) Inventors: Keita Arai, Nagano (JP); Daisuke Shiba, Nagano (JP); Masashi Suganuma, Nagano (JP); Atsushi Kato, Nagano (JP)

(73) Assignee: Nissei Plastic Industrial Co., Ltd. (JP)

( * ) Notice: Subject to any disclaimer, the term of this patent is extended or adjusted under 35 U.S.C. 154(b) by 750 days.

This patent is subject to a terminal disclaimer.

(21) Appl. No.: 11/985,522

(22) Filed: Nov. 15, 2007

(65) Prior Publication Data

US 2010/0282429 A1 Nov. 11, 2010

(30) Foreign Application Priority Data

Nov. 17, 2006 (JP) ..... P2006-312089

(51) Int. Cl.
*B22D 19/14* (2006.01)
*B22D 17/00* (2006.01)

(52) U.S. Cl. ..... 164/91; 164/97

(58) Field of Classification Search ..... 164/91, 164/97, 113, 123, 461, 900; 428/293.1; 264/122, 264/241

See application file for complete search history.

(56) References Cited

U.S. PATENT DOCUMENTS

| | | | | |
|---|---|---|---|---|
| 5,627,140 | A * | 5/1997 | Fossheim et al. | 505/401 |
| 7,311,135 | B1 * | 12/2007 | Suganuma et al. | 164/97 |
| 2004/0067153 | A1 * | 4/2004 | Koide et al. | 419/8 |
| 2008/0006385 | A1 * | 1/2008 | Suganuma et al. | 164/97 |

FOREIGN PATENT DOCUMENTS

| | | | |
|---|---|---|---|
| JP | 2004010978 | | 1/2004 |
| JP | 2006044970 | A * | 2/2006 |
| JP | 2006265686 | | 10/2006 |
| JP | 2006328507 | A * | 12/2006 |

OTHER PUBLICATIONS

JPO machine translation of JP 2006328507 A, Dec. 7, 2006.*
JPO machine translation of JP 2006044970 A, Feb. 16, 2006.*

* cited by examiner

*Primary Examiner* — Jessica L Ward
*Assistant Examiner* — Kevin E Yoon
(74) *Attorney, Agent, or Firm* — Adams & Wilks

(57) ABSTRACT

A method for producing a carbon nanocomposite metal material with increased carbon nanomaterial dispersibility and increased binding between carbon nanomaterial and matrix metal stock is disclosed. A preform obtained by mixing a matrix metal stock and microparticulate-coated carbon nanomaterial without the need for a dispersant and then compacting the material is maintained for a set time period at a temperature that is at or above the melting point of the matrix metal stock. In this state, the heat-treated body is reduced to a temperature that allows hot working, and a compacting treatment is performed.

12 Claims, 9 Drawing Sheets

METHOD FOR PRODUCING CARBON NANOCOMPOSITE METAL MATERIAL AND METHOD FOR PRODUCING METAL ARTICLE MOLDED THEREFROM

FIELD OF THE INVENTION

The present invention relates to a composite metal material produced using a carbon nanomaterial as a reinforcing material.

BACKGROUND OF THE INVENTION

The use of special carbon fibers referred to as carbon nanomaterials as reinforcing materials has received a great deal of attention in recent years, and various activation methods have been offered. Carbon nanofiber (CNF) which is a typical example of a carbon nanomaterial is a material in which a sheet of carbon atoms arranged in a hexahedral lattice is wound in the form of a tube. The material is referred to as a carbon nanofiber (or carbon nanotube) because the diameter is 1.0 to 150 nm (nanometers). The length is from a few micrometers to 100 μm.

When matrix metal stock is reinforced with carbon nanomaterial, it is necessary for the carbon nanomaterial to be dispersed uniformly in the matrix metal stock. This type of dispersion technique is known, for example, in Japanese Patent Application Laid-Open Publication No. 2006-265686 (JP 2006-265686 A).

A method for producing a nickel (Ni)/carbon nanotube (CNT) composite sintered body using the dispersion technology disclosed in JP 2006-265686 A referred to above is described in reference to the flow chart shown in FIG. 13 hereof.

In step ("ST" below) 101, the carbon nanotubes (CNTs), dispersant (sodium dodecyl sulfate), and solvent (purified water) are prepared, and the materials are combined and stirred/mixed for 1 h using ultrasound (ST102). In addition, in ST103, nickel (Ni) powder, dispersant (ammonium polyacrylate), binder (polyvinyl alcohol), and solvent (purified water) are prepared, the materials are combined, and stirring/mixing is carried out for 1 h using ultrasound (ST104).

The CNT suspension obtained in ST102 and the Ni slurry obtained in ST104 are combined, stirred/mixed by ultrasonication (ST105), and then heated to 80° C. and aggregated (ST106) to obtain an Ni/CT mixed slurry (ST107).

Next, the Ni/CNT mixed slurry is dried in two stages and compressed (ST108) to obtain a green molded body (ST109).

The resulting green molded body is defatted for 30 h (ST110) and then a sintering treatment is carried out under compression in a vacuum (ST111). An Ni/CNT composite sintered body is thereby obtained (ST112). With this technology, a favorable CNT dispersion will be produced based on inspection of the resulting Ni/CNT composite sintered body using a microscope.

The following conclusions regarding the above conventional technique were confirmed by the inventors of the present invention.

Firstly, production costs are high due to the necessity of a defatting treatment step (ST110) that lasts as long as 30 h.

Secondly, although dispersibility is favorable, the increase in strength is not as great as expected.

Specifically, the conventional technology has room for improvement in regard to production costs and strength increase.

SUMMARY OF THE INVENTION

An object of the present invention is to offer a production technology whereby strength can be improved while production costs can be reduced.

The inventors of the present invention conjectured that a lack of adhesion between the CNF and matrix (Ni) is the reason that strength is not improved as much as expected, in spite of the favorable dispersion. When adhesion is insufficient, slipping between the CNF and matrix occurs when the composite deforms under external force, resulting in a loss of the CNF strengthening action.

Thus, investigations were carried out in light of the idea that increasing adhesion between CNF and the matrix is effective in addition to CNF dispersion. Sufficient results were thus obtained.

According to one aspect of the present invention, there is provided a method for producing a carbon nanocomposite metal material, which comprises the steps of: preparing a matrix metal stock and a microparticulate-coated carbon nanomaterial, obtained by bonding microparticles having an element that reacts with carbon to generate a compound, to the entire surface of a carbon nanomaterial; mixing the microparticulate-coated carbon nanomaterial and the matrix metal stock; pre-molding by packing the resulting mixture; heating the resulting preform to a temperature that is at or above the melting point of the matrix metal stock in a vacuum, inert gas, or non-oxidative gas atmosphere, and maintaining the heating temperature for a set time period; compacting the resulting heat-treated body by performing cooling to a temperature that allows hot working of the matrix metal stock and performing compression for a prescribed time period at this temperature; and cooling the resulting compacted body.

In this manner, according to the production method of the present invention, a microparticulate-coated carbon nanomaterial in which microparticles containing an element that reacts with carbon to generate a compound are bonded to the entire surface of the carbon nanomaterial was selected as the starting material.

For example, when a carbon nanomaterial is mixed directly with the matrix metal stock, the carbon nanomaterial coagulates and dispersion suffers. In order to solve this problem, a dispersant has conventionally been added.

With the microparticulate-coated carbon nanomaterial used in the present invention, the surface microparticles exhibit a separating action, and thus a dispersant is not necessary. Because dispersant is not necessary, the defatting treatment step becomes unnecessary, allowing production costs to decrease.

When a preform produced by mixing and packing microparticulate-coated carbon nanomaterial and matrix metal stock is heated to a temperature that is at or above the melting point of the matrix metal stock and then left for a set time period, the melted microparticulate-coated carbon nanomaterial infuses into the matrix metal stock.

When, in this state, the temperature is reduced to a temperature at which hot-working is possible, and a compacting treatment is carried out, the carbon nanomaterial and matrix metal are tightly bonded via the microparticles, so the strength of the composite metal material can be greatly increased.

The temperature at which hot-working is possible is made as high as possible. When this is done, compacting can be carried out with low compressive force, and there is no concern regarding constraints such as the mold.

At temperatures that are lower than the temperature at which hot-working is possible, undesirable effects such as poor workability and cracking occur, and thus the compaction treatment is difficult. At high temperatures that are above the temperature at which hot-working is possible, a liquid phase state is produced, and leakage of the liquid phase occurs due to compression, so the compression force becomes less effective, making compaction difficult.

In the cooling step described above, it is preferred that the compacted body described above be cooled during compression. At the time of cooling, stresses will arise in the carbon nanocomposite metal material due to differences in the rate of cooling. In the present invention, the generation of stress is suppressed by compression. As a result, it is possible to obtain a well-formed carbon nanocomposite metal material.

In the cooling step described above, an extrusion molding step is carried out whereby the carbon nanocomposite metal material is extruded and molded. Because the carbon nanocomposite metal material is extrusion molded, the orientation of the carbon nanomaterial is increased, and a carbon nanocomposite metal material can be obtained that has superior mechanical strength, such as tensile strength.

It is preferred that the prepared microparticulate-coated carbon nanomaterial be produced by a mixed body formation step in which carbon nanomaterial and carbide-forming microparticles are mixed to obtain a mixed body; and a vacuum vapor deposition step in which the aforementioned carbide-forming microparticles are evaporated under high temperature and vacuum and are made to deposit on the surface of the aforementioned carbon nanomaterial. Consequently, the carbide-forming microparticles are uniformly bonded to the surface of the carbon nanomaterial, because the carbide-forming microparticles are evaporated under high temperature and vacuum and are bonded to the surface of the carbon nanomaterial.

In the mixed body formation step, it is preferred that the organic solvent, the carbide-forming microparticles, and the carbon nanomaterial be introduced into the mixing container, stirred, and dried. Consequently, coagulation of the carbon nanomaterial can be prevented by the organic solvent. The dispersed carbon nanomaterial can thus be coated with carbide-forming microparticles.

It is preferred that carbide-forming microparticles of Si or Ti be used. Both Si and Ti are metals that have a melting point that allows vacuum vapor deposition, and their wettability with respect to molten matrix metal is also favorable. Si and Ti are both readily procured, and Si is particularly inexpensive and thus desirable from the standpoint of proliferation of the method of the present invention.

The matrix metal stock referred to above is preferably Mg or an Mg alloy. In the production method of the present invention, treatment is carried out in a vacuum, and Mg and Mg alloy, which are susceptible to oxygen, can both be treated. Mg and Mg alloy are light metals, and because inclusion of carbon nanomaterial in these metals increases mechanical strength, a structural material that is light and strong can be provided which also has superior thermal transfer properties and abrasion resistance.

According to another aspect of the present invention, there is provided a method for producing a carbon nanocomposite molded article, which comprises the steps of: preparing a matrix metal stock and a microparticulate-coated carbon nanomaterial, obtained by bonding microparticles having an element that reacts with carbon to generate a compound, to the entire surface of a carbon nanomaterial; mixing the microparticulate-coated carbon nanomaterial and the matrix metal stock; pre-molding by packing the resulting mixture; heating the resulting preform to a temperature that is at or above the melting point of the matrix metal stock in a vacuum, inert gas, or non-oxidative gas atmosphere, and maintaining the heating temperature for a set time period; compacting the resulting heat-treated body by performing cooling to a temperature that allows hot working of the matrix metal stock and performing compression for a prescribed time period at this temperature; cooling the resulting compacted body; and die-casting the carbon nanocomposite metal material obtained after the cooling step.

In the carbon nanocomposite metal material produced by the production method for carbon nanocomposite metal materials, carbon nanomaterial is uniformly dispersed. By providing a material having this type of uniformly mixed condition and carrying out die cast molding, molding of molded articles having complex shapes can be readily carried out, and a composite metal molded article with high mechanical strength can be produced.

BRIEF DESCRIPTION OF THE DRAWINGS

Certain preferred embodiments of the present invention will be described in detail below, by way of example only with reference to the accompanying drawings, in which.

DETAILED DESCRIPTION OF THE PREFERRED EMBODIMENTS

Figure 1:
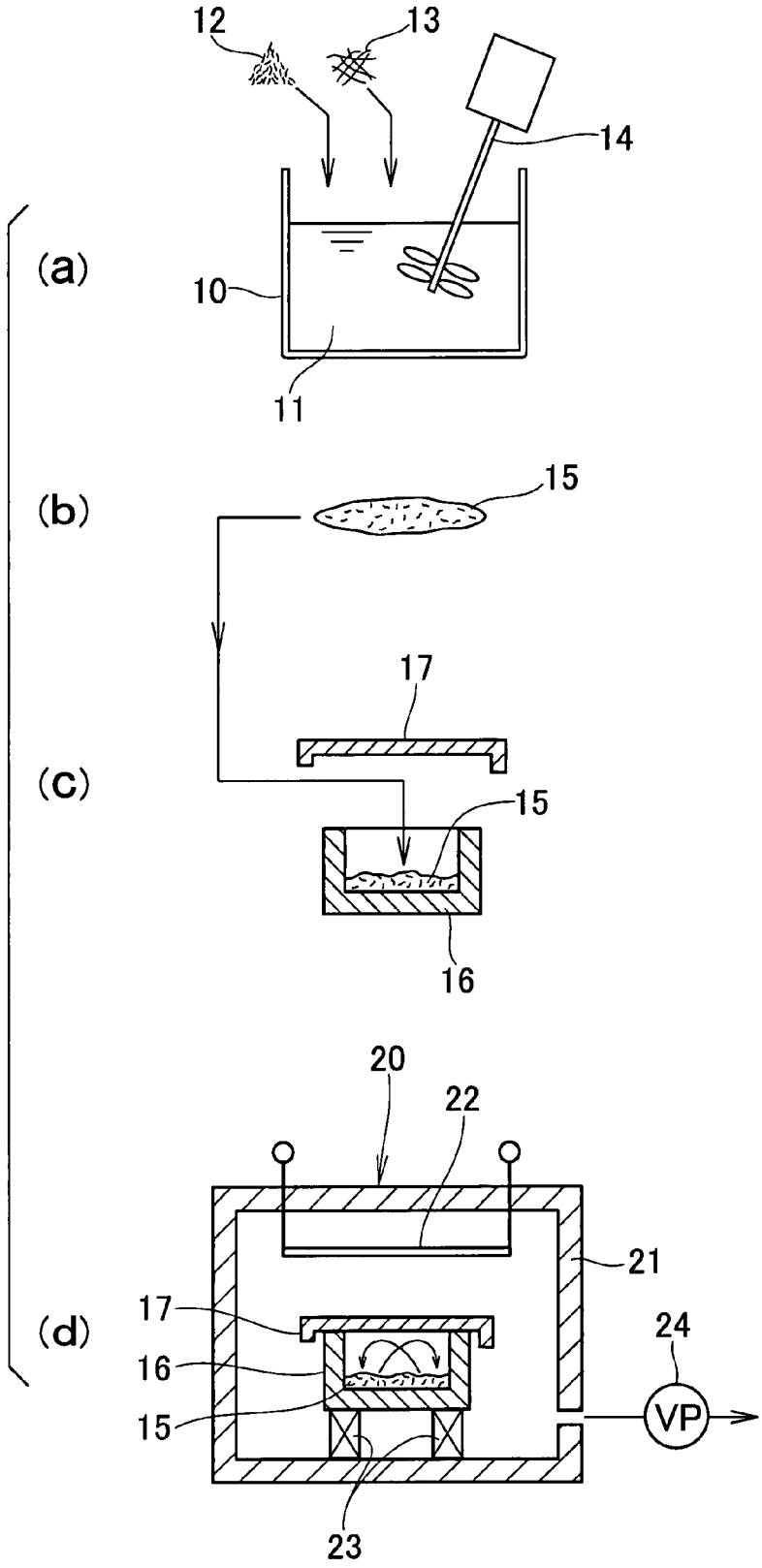
FIG. 1(*a*) to 1(*d*) are schematic views showing the mixed body formation step and vacuum vapor deposition step of the present invention.

As shown in FIG. 1(*a*), an organic solvent (e.g., 1 L of ethanol) 11 is introduced into a mixing container 10. Carbide-forming microparticles (e.g., 10 g of Si) 12 and a carbon nanomaterial (e.g., 10 g) 13 are introduced into the organic solvent 11. Next, thorough stirring is carried out with a stirrer 14 (e.g., 2 h at 750 rpm). Upon completion of stirring, the material is suction filtered and dried thoroughly (e.g., 3 h) in air at a high temperature (e.g., 100° C.), thereby producing a mixed body 15 shown in FIG. 1(*b*). FIG. 1(*a*) and FIG. 1(*b*) together constitute the mixed body formation step.

As shown in FIG. 1(*c*), the resulting mixed body 15 is introduced into a zirconium container 16 which is covered with a zirconium lid 17. This lid 17 is a non-sealing lid that allows passage of air between the interior and exterior of the container 16.

As shown in FIG. 1(*d*), a vacuum furnace 20 is prepared having a sealed furnace 21, a heating means 22 for heating the interior of the furnace 21, stands 23, 23 for supporting the container 16, and a vacuum pump 24 for evacuating the interior of the furnace 21. The container 16 is placed in this vacuum furnace 20.

In the vacuum furnace 20, heating is carried out for 20 h at 1200° C. in a vacuum. By heating in a vacuum, the Si powder in the mixed body 15 is evaporated. The evaporated Si contacts the surface of the carbon nanomaterial forming compounds, and the material is bonded as Si microparticles. FIGS. 1(*c*) and 1D constitute the vacuum vapor deposition step.

Figure 2:
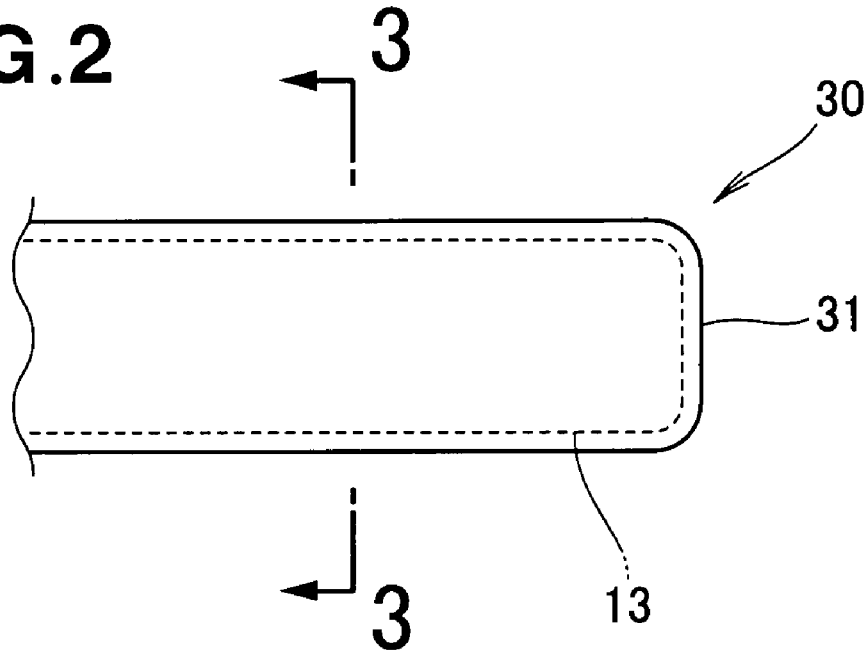
FIG. 2 is a schematic view showing the microparticulate-coated carbon nanomaterial.
Figure 3:
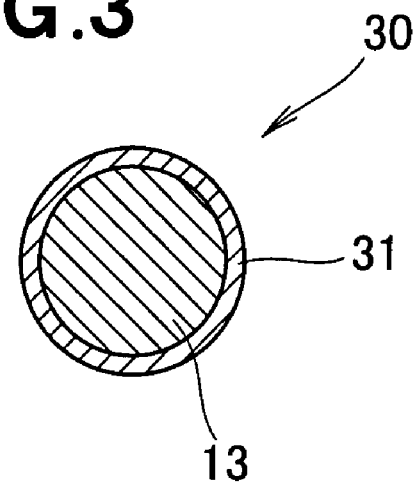
FIG. 3 is a cross-sectional view taken along line 3-3 of FIG. 2.

The structure of the resulting microparticulate-coated carbon nanomaterial is described in reference to FIG. 2 and FIG. 3.

With the microparticulate-coated carbon nanomaterial 30, the entire surface of the carbon nanomaterial 13 is coated with a layer of carbide-forming microparticles 31 (microparticles containing an element that reacts with carbon to form a compound over the entire surface).

Because carbide-forming microparticles are bonded to the surface of the carbon nanomaterial 13, an SiC reaction layer, for example, is formed at the interface, and the carbide-forming microparticle layer 31 is tightly bonded to the carbon nanomaterial 13. Consequently, there is no concern regarding release of the carbide-forming microparticle layer 31 from the carbon nanomaterial 13. In addition, the carbide-forming microparticle layer 31 has additionally improved wettability with respect to the matrix metal relative to the carbon nanomaterial 13.

Figure 4:
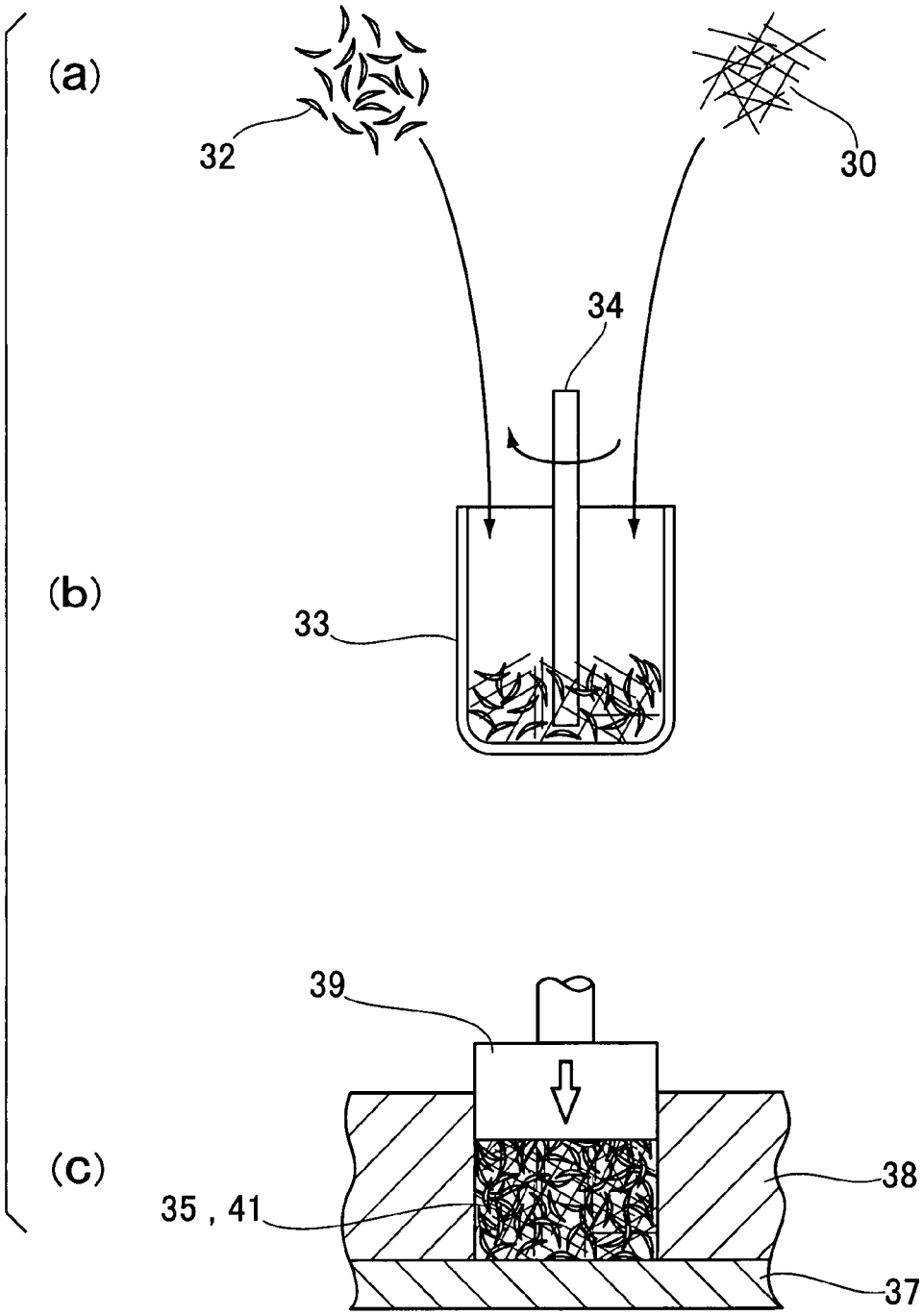
FIG. 4(*a*) to 4(*c*) are schematic views showing the preparation step, the mixing step, and the preform step of the present invention.

FIGS. 4(*a*), 4(*b*) and 4(*c*) show the preparation step, mixing step, and preforming step.

In the preparation step of FIG. 4(*a*), the microparticulate-coated carbon nanomaterial 30 and a matrix metal stock 32 produced by cutting from metal ingot are prepared.

In the mixing step of FIG. 4(*b*), the microparticulate-coated carbon nanomaterial 30 and the matrix metal stock 32 produced by cutting from metal ingot are introduced into a container 33 and are thoroughly mixed with a rod 34. The matrix metal stock 32 is, for example, pure Mg or Mg alloy.

In the preforming step of FIG. 4(*c*), a die 38 is placed on a base 37. A mixture 35 is then loaded into this die 38. Next, a punch 39 is inserted, thereby packing the mixture 35. The packed material is the preform 41.

Figure 5:
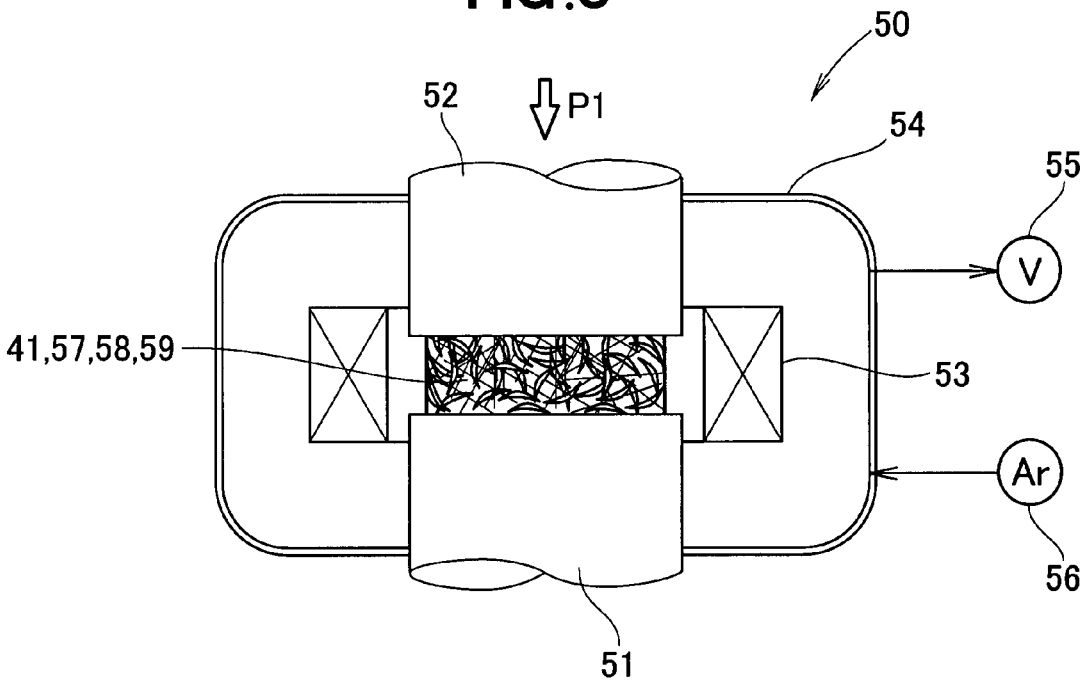
FIG. 5 is a schematic view illustrating the treatment apparatus used in the heating treatment step, compacting step, and cooling step of the present invention.

FIG. 5 shows the principle of the treatment apparatus used in the heating step, compacting step, and cooling step of this embodiment.

The treatment apparatus 50 is composed of a lower punch 51 that supports the preform 41, an upper punch 52 that is situated opposite the lower punch 51 and constricts the preform 41 or compresses (pressurizes) it at a compressive force P1, a heater 53 that surrounds the preform 41, a chamber 54 that entirely surrounds the heater 53, preform 41, and the like, an evacuation device 55 that is connected to this chamber 54 and places the interior of the chamber 54 in an evacuated state, and an inert gas suction device 56 that suctions argon inert gas into the chamber 54. This treatment apparatus 50 is controlled in accordance with the control graph shown in FIG. 6.

Figure 6:
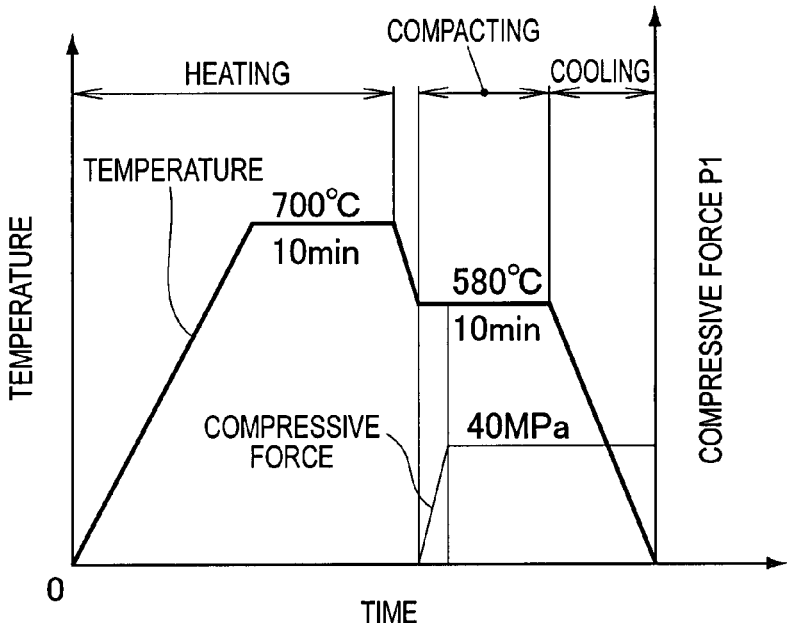
FIG. 6 is a graph illustrating the heating treatment step, compacting step, and cooling step.

FIG. 6 is a graph showing the heating step, compacting step, and cooling step.

In the heating step, the interior of the chamber is placed in an evacuated condition, and an inert gas such as argon or a non-oxidative gas such as nitrogen is introduced while maintaining this evacuation or subsequent thereto. Next, the preform is heated to 700° C. at a prescribed rate of heating (temperature elevation), and, upon reaching 700° C., the material is maintained for 10 min to obtain a heat-treated body 57 shown in FIG. 5.

Because the melting point of Mg is 650° C., the matrix metal stock melts when heated to 700° C. and infuses into the microparticulate-bonded carbon material. Thorough infusion is allowed to occur by retention for 10 min.

By decreasing the setting temperature of the heater 53 shown in FIG. 5, the heat-treated body 57 is cooled to a temperature at which the matrix metal stock can be hot-worked. Because the melting point of Mg is 650° C., if the material is cooled to 580° C. which is about 70° C. therebelow, the surface will thoroughly solidify, and there will be no concern regarding leakage of the liquid phase under compression.

Upon reaching 580° C., the top punch 52 is lowered, and a pressure of 40 MPa is applied to the heat-treated body 57. The material is maintained for 10 min at 580° C. under compression. During this retention, the upper punch 52 is gradually lowered. This lowering is continued for 5 to 7 min, and subsequently lowering is stopped. When the upper punch 52 is moving downwards, slight gaps are present in the structure, and the gaps are compacted. When the lowering of the upper punch 52 stops, it can be concluded that sufficient density has been attained. The resulting compacted body 58 is thus well compacted.

This compaction can be carried out at a temperature that allows hot working of the matrix metal stock, but the required compressive force for compaction depends on the temperature. Compaction can be carried out with a smaller compressive force when the temperature is high, and compaction can be readily carried out even with carbon molds that are not very strong. It is thus preferable to carry out compaction in a temperature range that is as high as possible.

Workability is poor at low temperatures that are below the hot working temperature, and with Mg or Mg alloy matrix metal stock in particular, cracking, fissures, and the like readily occur, making compaction difficult.

At high temperatures in excess of the hot working temperature, a liquid-phase condition is produced, and leaking of liquid phase will occur under compression, so the compressive force becomes less effective, making compaction difficult.

The resulting compacted body 58 can yield a carbon nanocomposite metal material 59 when cooled to normal temperatures while being constrained by the upper punch 52. In the compacted body 58, the surface temperature decreases first, and the temperature of the inner sections decreases slowly. Thus, there are cases where stress referred to as cooling stress is generated due to the temperature differential. By continued constraint applied using the upper punch 52, it is possible to suppress the generation of cooling stress. However, when there is no concern regarding cooling stress, cooling may be carried out without a compressive force (without the compacted body 58 being constrained by the upper punch 52).

An example of extrusion molding of the unextruded carbon nanocomposite metal material 59 will be described below.

Figure 7:
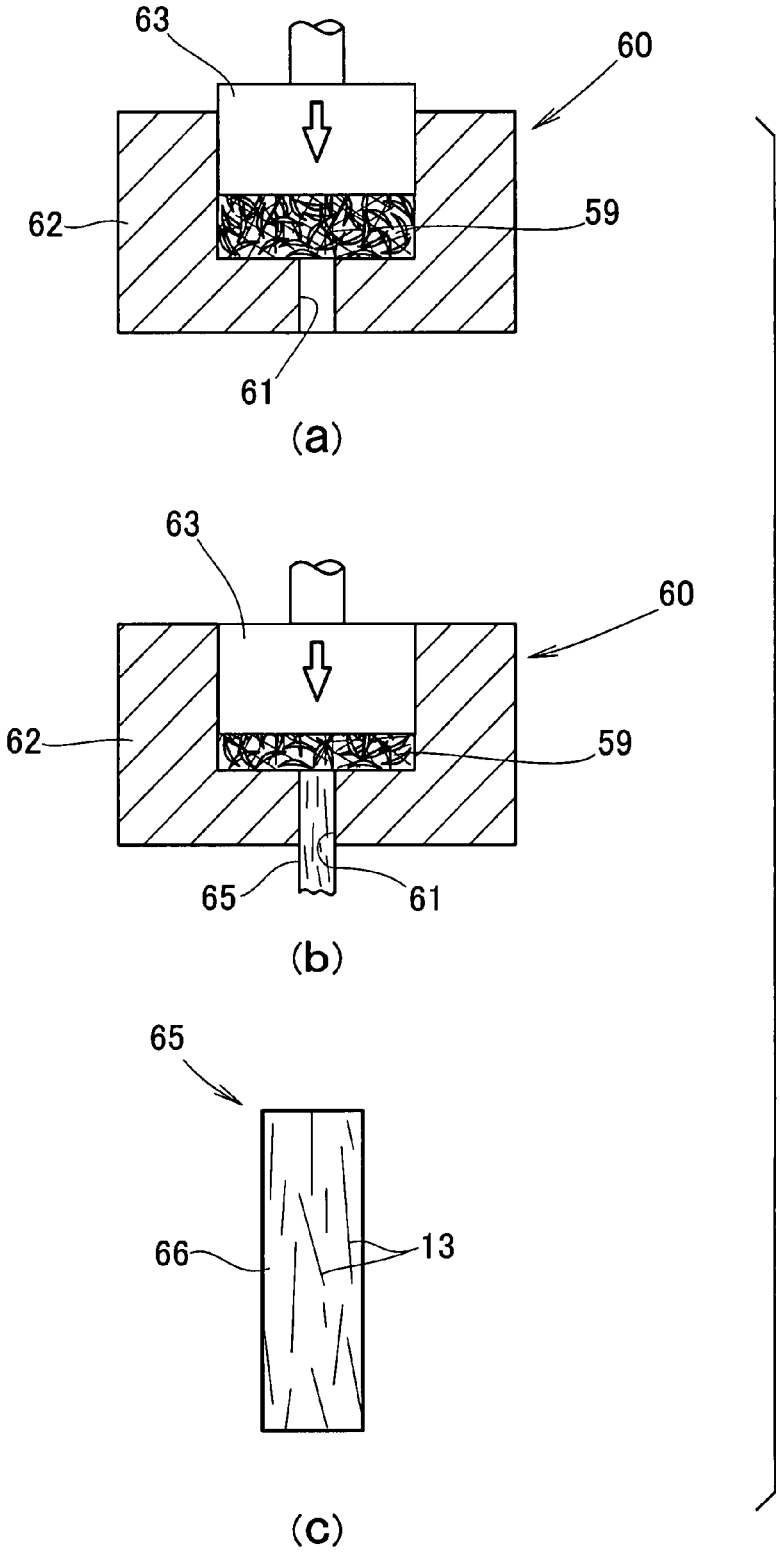
FIG. 7(*a*) to 7(*c*) are schematic views showing extrusion molding.

FIGS. 7(*a*), 7(*b*), and 7(*c*) are explanatory diagrams for the extrusion step of this embodiment.

In FIG. 7(*a*), an extrusion apparatus 60 composed of a container 62 having a hole 61 and a ram 63 is prepared, the container 62 is heated to the prescribed temperature, and the carbon nanocomposite metal material 59 is retained therein. Next, the ram 63 is extruded in the direction indicated by the white arrow.

In FIG. 7(*b*), an extruded carbon nanocomposite metal material 65 is obtained as a result of being extruded from the hole 61.

FIG. 7(*c*) shows the exterior of the extruded carbon nanocomposite metal material 65, where carbon nanomaterial 13 oriented in the direction of extrusion can be observed on a surface 66.

A sufficient amount of carbon nanomaterial 13 is contained on the surface, thereby improving abrasion resistance.

Although not shown in the drawing, when a cross section of the carbon nanocomposite metal material 65 is observed, the carbon nanomaterial 13 oriented in the extrusion direction can be observed in the cross section. The carbon nanomaterial 13 is thus uniformly dispersed, increasing the mechanical strength.

Figure 8:
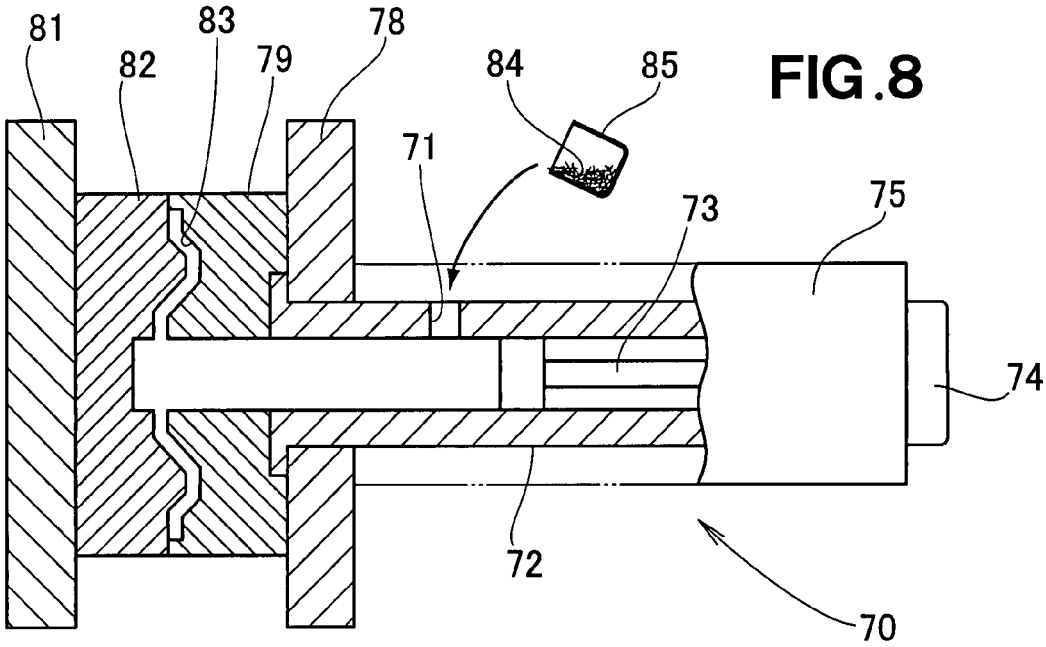
FIG. 8 is a schematic view showing die-cast molding.

FIG. 8 is a principle diagram for die-cast molding pertaining to the present invention, where a metal molding apparatus 70 is prepared for performing die-cast molding. This metal molding apparatus 70, for example, is preferably a die-casting machine apparatus wherein a plunger 73 is housed in a heating tube 72 provided with a material feed port 71 so that the plunger can undergo reciprocating movement. The plunger 73 is driven by an injection cylinder 74, the main section is covered with a cover 75, and the end of the heating tube 72 meets a fixed plate 78. A fixed mold 79 is attached to the fixed plate 78, and by attaching a movable mold 82 to an opposing movable plate 81, a cavity 83 is formed between the molds 79 and 82.

The carbon nanocomposite metal material 65 shown in FIG. 7(*c*) or the carbon nanocomposite metal material 59 shown in FIG. 5 is heated to a partially-melted temperature, thus producing a partially melted material 84. This partially melted material 84 is then poured into the heating tube 72 from the material supply opening 71 using the container 85 or a suitable supply mechanism. Next, by advancing the plunger 73, the partially melted material 84 is injected into the cavity 83.

When heating is stopped at the partial melting temperature, the matrix melt is a mixture of solid phase and liquid phase, and movement of the carbon nanomaterial is restricted. As a result, dispersion of the carbon nanomaterial is maintained.

Figure 9:
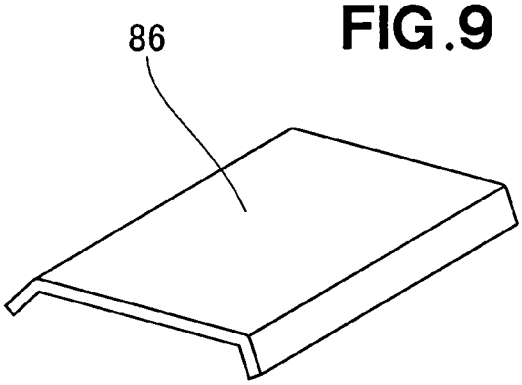
FIG. 9 is an perspective view of a carbon nanocomposite metal molded article produced by the cast molding apparatus shown in FIG. 8.

FIG. 9 shows that a carbon nanocomposite metal molded article 86 with a complicated shape can be produced by the metal molding apparatus 70 of FIG. 8.

The carbon nanocomposite metal material 65 produced by the method for producing carbon nanocomposite metal materials has a uniformly dispersed carbon nanomaterial. Because die-cast molding is carried out by supplying material in this uniformly mixed condition, it is possible to readily carry out molding, even with molded articles having complicated shapes. In addition, a carbon nanocomposite metal molded article 86 can be produced that has high thermal conductivity, mechanical strength, and abrasion resistance.

Experimental Examples

Experimental examples pertaining to the present invention are described below, but the present invention is not restricted to these examples.

Mixed body formation step and vacuum vapor deposition step: As shown in FIG. 1, microparticulate-coated carbon nanomaterial was produced using Si particles (carbide-forming particles) with a particle diameter of 4 μm along with a carbon nanomaterial (gas phase-grown carbon fiber) having an average diameter of 150 nm and a length of 10 to 20 μm.

Preparation step: As shown in FIG. 4(*a*), the aforementioned microparticulate-coated carbon nanomaterial and Mg particles with a purity of 99.9% and a particle diameter 180 μm (or AZ91D, Mg alloy particles) for use as matrix metal stock were prepared.

The composition of the Mg alloy as defined in ASTM AZ91D (magnesium alloy die-cast JIS H 5303; product analogous to MDC1D) had an Al content of about 9 wt %, with the remainder being trace elements, inevitable impurities, and Mg.

Mixing step: As shown in FIG. 4(*b*), the microparticulate-coated carbon nanomaterial was mixed at 5 to 20 mass %.

Preforming step: As shown in FIG. 4(*c*), a preform was produced.

Figure 10:
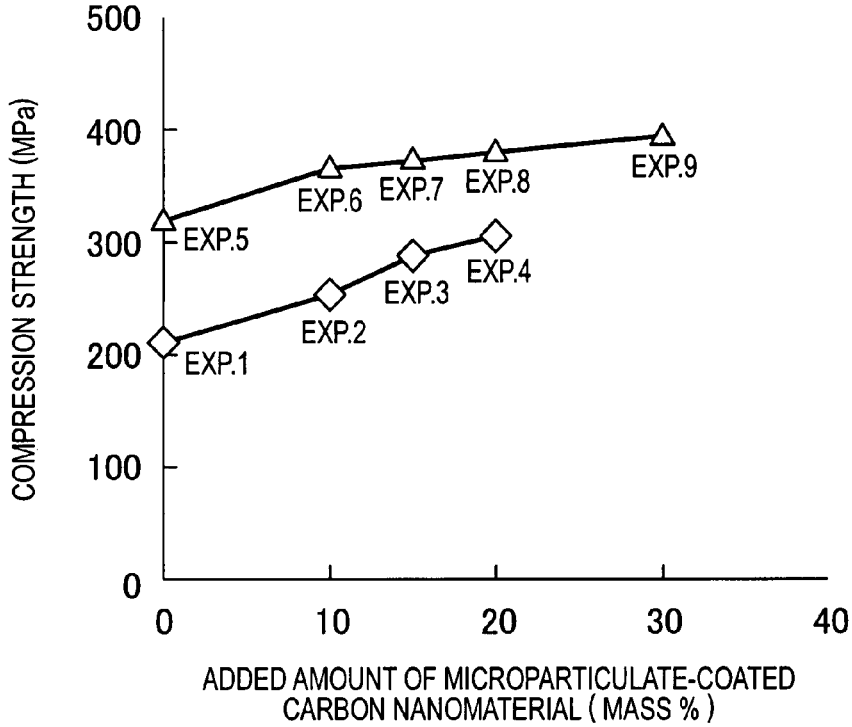
FIG. 10 is a graph shown a correlation between the added amount of microparticulate-coated carbon nanomaterial and compression strength.

Heat treatment step: As shown in FIG. 5 and FIG. 6, 10-min retention was performed in an argon atmosphere at 700° C. (650° C. for AZ91D).

Compacting step: As shown in FIG. 5 and FIG. 6, 10-min retention was carried out in an argon atmosphere at a compressive force of 40 MPa and 580° C. (480° C. for AZ91D).

Cooling step: As shown in FIG. 5 and FIG. 6, cooling to normal temperature was carried out while applying a compressive force of 40 MPa in an argon atmosphere, thus producing a carbon nanocomposite metal material with a diameter of 60 mm and a height of 20 mm.

First evaluation: Sample strips were cut from the carbon nanocomposite metal material prior to extrusion, and the compressive force was measured. The measured values are presented in Table 1 below.

TABLE 1

(%: mass %)

| No. | Micro-particulate-coated carbon nanomaterial | Matrix metal Pure Mg | Matrix metal AZ91D | Compression strength | Ratio |
|---|---|---|---|---|---|
| Experiment 1 | 0% | 100% | — | 210 MPa | (100 |
| Experiment 2 | 10% | 90% | — | 253 MPa | 120 |
| Experiment 3 | 15% | 85% | — | 288 MPa | 137 |
| Experiment 4 | 20% | 80% | — | 305 MPa | 145 |
| Experiment 5 | 0% | — | 100% | 320 MPa | (100) |
| Experiment 6 | 10% | — | 90% | 366 MPa | 114 |
| Experiment 7 | 15% | — | 85% | 371 MPa | 116 |
| Experiment 8 | 20% | — | 80% | 378 MPa | 118 |
| Experiment 9 | 30% | — | 70% | 396 MPa | 124 |

Experiments 1 to 4 employed pure Mg as matrix metal, and Experiments 5 to 9 employed AZ91D as matrix metal. With Experiments 1 and 5, a structure was produced that contained no microparticulate-coated carbon nanomaterial for purposes of comparison. Experiment 4 gave a value of 145, taking Experiment 1 as 100, and the compression strength increased by 45% due to the 20 mass % content of microparticulate-coated carbon nanomaterial.

FIG. 10 is a diagram showing the correlation between the added amount of microparticulate-coated carbon nanomaterial and the compression strength, where a graph was obtained by plotting the compression strengths of Table 1.

In Experiment 1 to Experiment 4, it was confirmed that compression strength increased in proportion to the added amount of microparticulate-coated carbon nanomaterial. In Experiments 5 to 9 as well, it was confirmed that compression strength increased in proportion to the added amount of microparticulate-coated carbon nanomaterial.

Next, an experiment was carried out in which an extrusion molding process was carried out on the carbon nanocomposite metal material prior to the extrusion treatment.

Extrusion molding step: Extrusion molding was carried out in reference to FIG. 7. Material was cut at a diameter of 43 mm and a height of 15 mm from the aforementioned carbon nanocomposite metal material and was extruded under conditions of an extrusion temperature of 350° C., an extrusion ratio of 25, and a ram rate of 4 mm/sec, thus producing an extruded material with a diameter of 8 mm (extruded carbon nanocomposite metal material).

Second evaluation: A test strip (7 mm in diameter, 7 mm in height) was cut from the extruded material (extruded carbon nanocomposite metal material), and the compression strength was measured. The measured values are presented in Table 2 below.

TABLE 2

(%: mass %)

| No. | Micro-particulate-coated carbon nanomaterial | Matrix metal Pure Mg | Matrix metal AZ91D | Compression strength | Ratio |
|---|---|---|---|---|---|
| Experiment 11 | 0% | 100% | — | 299 MPa | (100 |
| Experiment 12 | 10% | 90% | — | 350 MPa | 117 |
| Experiment 13 | 15% | 85% | — | 354 MPa | 118 |
| Experiment 14 | 20% | 80% | — | 363 MPa | 121 |
| Experiment 15 | 0% | — | 100% | 412 MPa | (100) |
| Experiment 16 | 10% | — | 90% | 432 MPa | 105 |
| Experiment 17 | 15% | — | 85% | 456 MPa | 111 |
| Experiment 18 | 20% | — | 80% | 470 MPa | 114 |
| Experiment 19 | 30% | — | 70% | 475 MPa | 115 |

For purposes of convenience, the test numbers were produced by adding 10 to the number of Experiments 1 to 9, yielding Experiments 11 to 19. Specifically, extrusion was added to Experiment 1 in Experiment 11, and extrusion was added to Experiments 2 to 9 in Experiments 12 to 19.

Experiments 11 to 14 employed pure Mg as matrix metal, and Experiments 15 to 19 employed AZ91D as matrix metal. With Experiments 11 and 15, a structure was produced that contained no microparticulate-coated carbon nanomaterial for purposes of comparison. Experiment 14 gave a value of 121, taking Experiment 11 as 100, and the compression strength thus increased by 21% due to the 20 mass % content of microparticulate-coated carbon nanomaterial.

Figure 11:
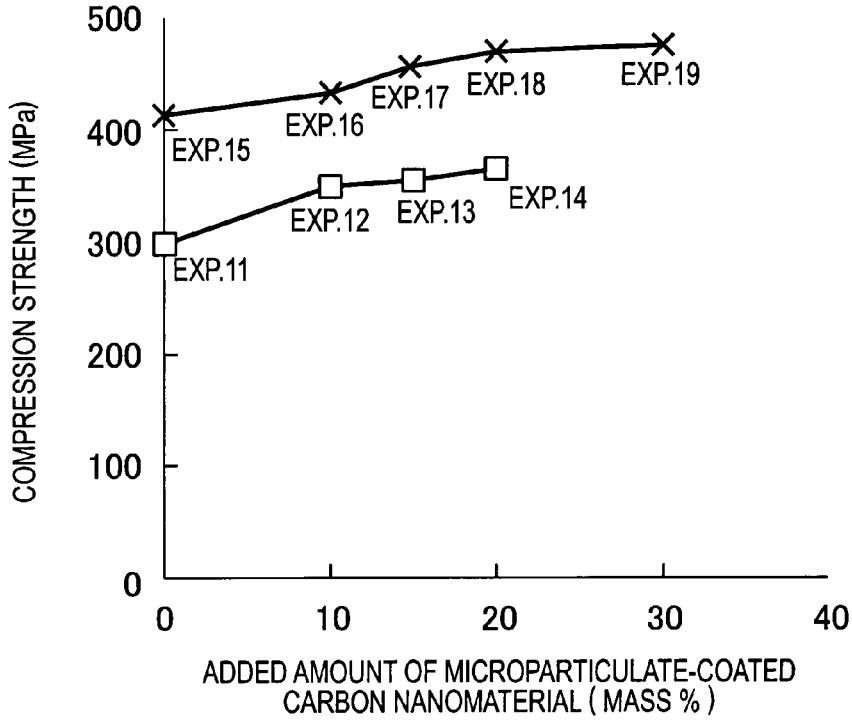
FIG. 11 is a graph showing a correlation between the added amount of microparticulate-coated carbon nanomaterial and compression strength subsequent to extrusion molding.

FIG. 11 is a diagram showing the correlation between the added amount of microparticulate-coated carbon nanomaterial and the compression strength, where a graph was obtained by plotting the compression strengths of Table 2. In Experiment 11 to Experiment 14, it was confirmed that the compression strength increased in proportion to the added amount of microparticulate-coated carbon nanomaterial. In Experiments 15 to 19 as well, it was confirmed that the compression strength increased in proportion to the added amount of microparticulate-coated carbon nanomaterial.

Figure 12:
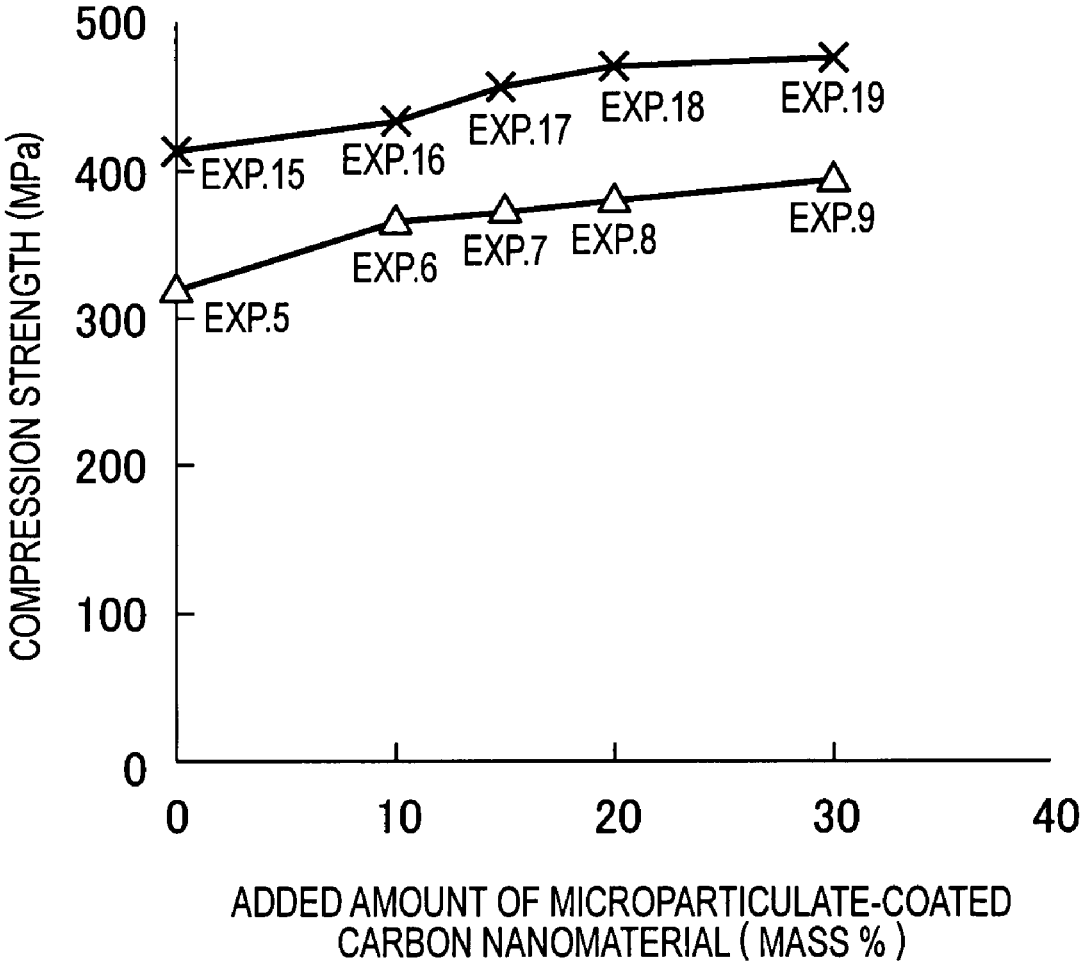
FIG. 12 is a graph showing comparisons between Experiments 5 to 9 and Experiments 15 to 19.
Figure 13:
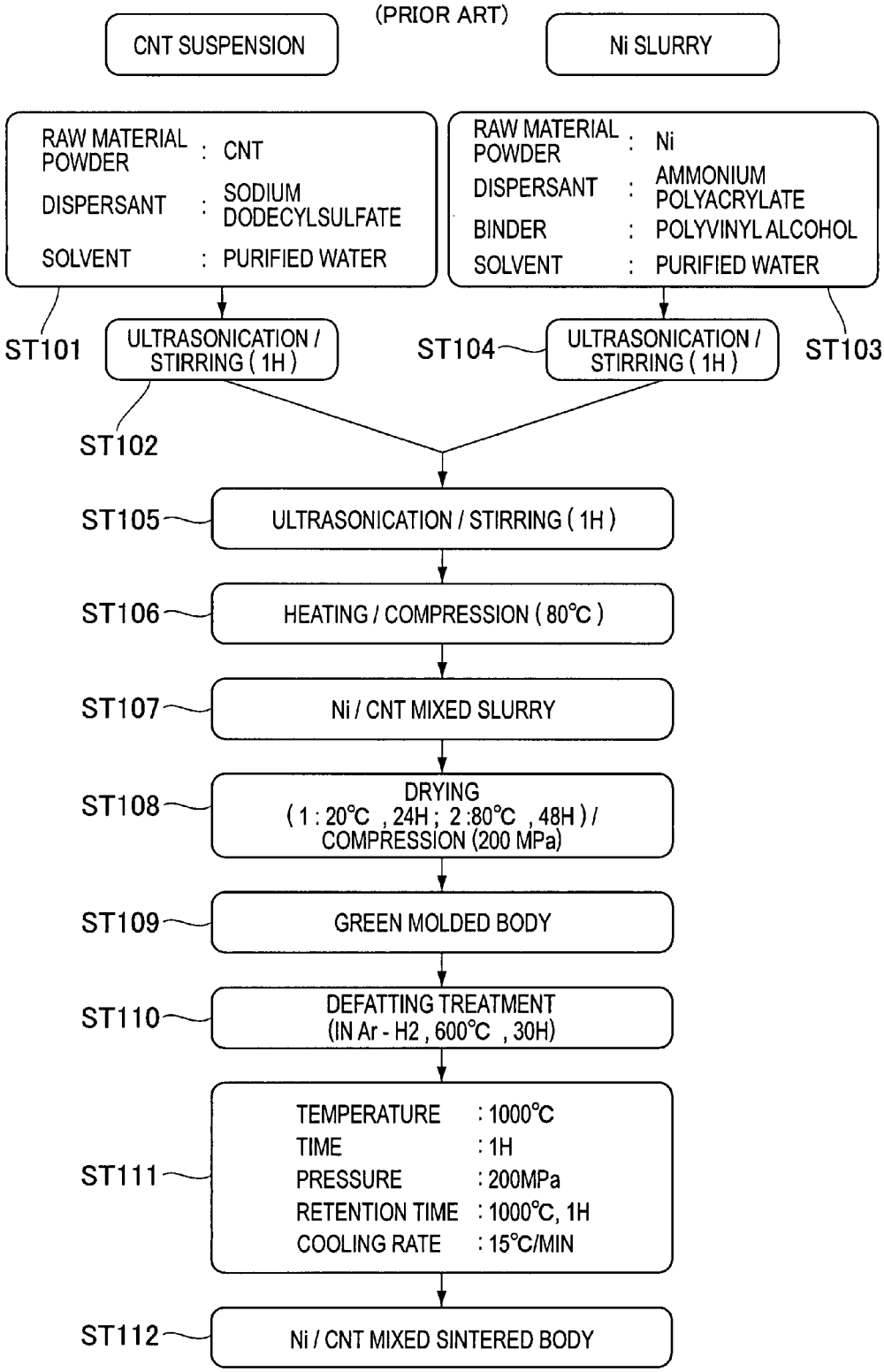
FIG.13 (PRIOR ART)
FIG. 13 is a flowchart showing the production steps for a conventional carbon nanocomposite metal material.

FIG. 12 is a graph that shows Experiments 5 to 9 and Experiments 15 to 19 in parallel. In comparison to Experiments 5 to 9 in which extrusion molding was not carried out, Experiments 15 to 19 that involved extrusion molding showed an increased in compression strength of 90 to 100 MPa. It was thus confirmed that the effects of extrusion molding are dramatic.

Although the details are not presented, a similar increase in mechanical strength was obtained when Ti was used instead of Si as the carbide-forming metal (element that reacts with metallic carbon to form compound). In addition to Si and Ti, zirconium (Zr) or vanadium (V) may be used as the carbide-forming metal.

In addition to Mg or Mg alloy having a melting point of about 650° C., Al or Al alloy having a melting point of about 660° C., Sn or Sn alloy having a melting point of about 232° C., or Pb or Pb alloy having a melting point of about 327° C. may be used as the matrix metal stock.

Obviously, various minor changes and modifications of the present invention are possible in light of the above teaching. It is therefore to be understood that within the scope of the appended claims the invention may be practiced otherwise than as specifically described.

What is claimed is:

1. A method for producing a carbon nanocomposite metal material, comprising the steps of:

preparing a matrix metal stock of Mg or Mg alloy;

preparing a microparticulate-coated carbon nanomaterial by bonding carbide-forming microparticles, which have an element that reacts with carbon to generate a compound, to the entire surface of a carbon nanomaterial;

mixing the microparticulate-coated carbon nanomaterial and the matrix metal stock;

pre-molding by packing the resulting mixture to form a preform;

heating the resulting preform to a temperature that is at or above the melting point of the matrix metal stock in a vacuum, inert gas, or non-oxidative gas atmosphere, and maintaining the heating temperature for a set time period so as to cause the matrix metal stock to be completely melted and then to infuse into the microparticulate-coated carbon nanomaterial;

compacting the resulting heat-treated preform by performing cooling to a temperature that allows hot working of the matrix metal stock and that allows a surface layer of the heat-treated perform to thoroughly solidify to prevent the matrix metal stock in a liquid phase from leaking out from the heat-treated preform under compression, and performing compression for a prescribed time period at this temperature; and cooling the resulting compacted body.

2. The method of claim 1, wherein the cooling step comprises cooling the compacted body under compression.

3. The method of claim 1, wherein the carbon nanocomposite material is extrusion molded after the cooling step.

4. The method of claim 1, wherein the step of preparing a microparticulate-coated carbon nanomaterial comprises:

a mixed-body forming step wherein a mixed body is obtained by mixing the carbon nanomaterial and the carbide-forming microparticles; and a vacuum vapor depositing step wherein the resulting mixture is introduced into a vacuum furnace, and the carbide-forming microparticles are evaporated in a high-temperature vacuum and bonded to the surface of the carbon nanomaterial.

5. The method of claim 4, wherein the mixed body formation step comprises introducing an organic solvent, the carbide-forming microparticles, and the carbon nanomaterial into a mixing container; and stirring and drying these contents.

6. The method of claim 4, wherein the carbide-forming microparticles are Si or Ti.

7. A method for producing a carbon nanocomposite molded article, comprising the steps of:

preparing a matrix metal stock of Mg or Mg alloy;

preparing a microparticulate-coated carbon nanomaterial by bonding carbide-forming microparticles, which have an element that reacts with carbon to generate a compound, to the entire surface of a carbon nanomaterial;

mixing the microparticulate-coated carbon nanomaterial and the matrix metal stock;

pre-molding by packing the resulting mixture to form a preform;

heating the resulting preform to a temperature that is at or above the melting point of the matrix metal stock in a vacuum, inert gas, or non-oxidative gas atmosphere, and maintaining the heating temperature for a set time period so as to cause the matrix metal stock to be completely melted and then to infuse into the microparticulate-coated carbon nanomaterial;

compacting the resulting heat-treated preform by performing cooling to a temperature that allows hot working of the matrix metal stock and that allows a surface layer of the heat-treated perform to thoroughly solidify to prevent the matrix metal stock in a liquid phase from leaking out from the heat-treated preform under compression, and performing compression for a prescribed time period at this temperature;

cooling the resulting compacted body; and die-casting the carbon nanocomposite metal material obtained after the cooling step.

8. The method of claim 7, wherein the cooling step comprises cooling the compacted body under compression.

9. The method of claim 7, wherein the die-casting step is carried out using the carbon nanocomposite metal material obtained by extrusion molding the carbon nanocomposite material obtained in the cooling step.

10. The method of claim 7, wherein the step of preparing a microparticulate-coated carbon nanomaterial comprises:

a mixed-body forming step wherein a mixed body is obtained by mixing the carbon nanomaterial and the carbide-forming microparticles; and a vacuum vapor depositing step wherein the resulting mixture is introduced into a vacuum furnace, and the carbide-forming microparticles are evaporated in a high-temperature vacuum and bonded to the surface of the carbon nanomaterial.

11. The method of claim 10, wherein the mixed body formation step comprises introducing an organic solvent, the carbide-forming microparticles, and the carbon nanomaterial into a mixing container; and stirring and drying these contents.

12. The method of claim 10, wherein the carbide-forming microparticles are Si or Ti.

* * * * *